United States Patent [19]

Barten

[11] Patent Number: 4,894,593

[45] Date of Patent: Jan. 16, 1990

[54] METHOD OF CORRECTING ELECTRON BEAM MISCONVERGENCE IN A COLOR DISPLAY TUBE AND A COLOR DISPLAY TUBE SYSTEM

[75] Inventor: Piet G. J. Barten, Eindhoven, Netherlands

[73] Assignee: U.S. Philips Corporation, New York, N.Y.

[21] Appl. No.: 47,752

[22] Filed: May 7, 1987

[30] Foreign Application Priority Data

May 9, 1986 [GB] United Kingdom ..... 8611321

[51] Int. Cl.[4] ..... H01J 29/70; H01J 29/76

[52] U.S. Cl. ..... 315/368; 335/211

[58] Field of Search ..... 315/368; 335/211, 213; 358/10

[56] References Cited

U.S. PATENT DOCUMENTS

| | | | |
|---|---|---|---|
| 4,390,815 | 6/1983 | Key et al. | 315/368 |
| 4,451,807 | 5/1984 | McGlashan et al. | 335/211 |
| 4,606,729 | 8/1986 | Kuiper | 335/211 |
| 4,662,853 | 5/1987 | Van Veldhoven | 315/368 |

*Primary Examiner*—Theodore M. Blum

*Attorney, Agent, or Firm*—John C. Fox

[57] ABSTRACT

A method of post deflection correction of electron beam misconvergence in a color display tube, the method comprising: providing at least one permanently magnetizable substantially annular element externally of the tube envelope on the screen side of the plane of deflection of the deflection yoke; measuring the convergence errors at the screen; and magnetizing the element as a multipole to correct for the measured errors. The annular element may be mounted directly on the tube envelope, or may be secured to the deflection yoke.

16 Claims, 3 Drawing Sheets

METHOD OF CORRECTING ELECTRON BEAM MISCONVERGENCE IN A COLOR DISPLAY TUBE AND A COLOR DISPLAY TUBE SYSTEM

BACKGROUND OF THE INVENTION

The present invention relates to a colour display tube system and more particularly to a method of correcting dynamic electron beam misconvergence in a colour display tube.

It is known to correct for static convergence errors occurring particularly in in-line electron gun display tubes by means of a series of pairs of pre-magnetized rings mounted externally on the neck of a display tube in the vicinity of the centering cup. The pairs of rings are pre-magnetized as two-, four- and six-pole magnets respectively, and by rotating the rings of each pair relative to each other static convergence errors can be corrected. In an alternative arrangement such errors can be corrected by at least one permanently magnetizable ring disposed in or around the tube neck or mounted on the electron gun so as to surround the three beam paths. Initially the convergence errors are detected and subsequently the magnetizable ring is magnetized as a multipole, the number and strength of the poles being selected in response to the particular convergence errors detected. A suitable magnetizing method is disclosed and claimed in British Patent Specification No. 2.000.635 B (PHN 8845).

When a deflection yoke is mounted on a tube neck, even one having coils wound to a tight production spread, it has been found that misconvergence of the electron beams occur as the beams are scanned, for example raster scanned, across the faceplate. Various theories have been put forward as to why such misalignments occur and in those cases where saddle coils are used the actual laying down of the wires in each coil may not be the same from coil to coil and also it is believed that bends in the coils could give rise to dynamic convergence errors.

It is an object of the present invention to correct for dynamic convergence errors in a colour display tube.

SUMMARY OF THE INVENTION

According to one aspect of the present invention there is provided a method of correcting electron beam misconvergence in a colour display tube, the tube comprising: an envelope consisting of an optically transparent faceplate, a conical portion and a neck, and within the envelope an electron gun system in the neck for producing a plurality of electron beams and a cathodoluminescent screen on the inside of the faceplate; and electron beam deflection means being arranged on the neck-cone transition of the envelope. The method comprises: providing at least one magnetisable substantially annular element externally of the envelope on the screen side of a plane of deflection of the deflection means; measuring the convergence of the electron beams at the screen with the deflection means in situ; and permanently magnetizing the annular element as a multipole, the number of poles and their respective strengths being such as to correct for the measured dynamic convergence errors.

According to a second aspect of the present invention there is provided a colour display tube system comprising: a colour display tube having an envelope consisting of an optically transparent faceplate, a conical portion and a neck and within the envelope an electron gun system in the neck for producing a plurality of electron beams and a cathodoluminescent screen on the inside of the faceplate; and an electron beam deflection means arranged on the neck-cone transition of the envelope, the deflection means having a plane of deflection; wherein at least one substantially annular element permanently magnetized as a multipole is provided externally of the envelope on the screen side of the plane of deflection.

The present invention is based on the recognition of the fact that dynamic convergence errors and any residual static convergence errors can be corrected after deflection of the electron beams have taken place. By using a magnetization method based on that disclosed in British Patent Specification No. 2.000.635 B, if it should be found that the multipole field produced is not quite correct, then the annular element can be remagnetized easily. As the annular element is magnetized at the stage of mounting the deflection yoke onto the display tube then static convergence errors as well as dynamic convergence errors can be corrected at the same time. The substantially annular element or elements provides more degrees of freedom in which to correct for convergence errors than are available to a display tube designer who is only able to correct for static convergence errors.

British Patent Specification No. 2089112A discloses providing a ring of permanently magnetizable material at approximately the centre of the deflection field, which ring is magnetized as a multipole either to improve the spot shape, by removing astigmatic errors, in a monochrome display tube or to reduce convergence errors in a colour display tube having three electron guns. This specification is primarily concerned with modifying the magnetic field present at the centre of the deflection area, if necessary with additional compensating corrections at the entrance of the deflection area. However there is no disclosure or suggestion of applying post deflection corrections for dynamic convergence errors in a colour display tube. In any event such an arrangement disclosed in British Patent Specification No. 2089112A cannot optimize the correction of dynamic convergence errors which will lead to mislanding of the electron beams because in order to make the corrections it is necessary to know where the electron beams are going. Consequently the deflection of the electron beams which are of a small cross-section must be distinctive. This will not be apparent at the plane of deflection and therefore any corrections made at the centre of the deflection yoke will be less than optimum. The method in accordance with the present invention enables dynamic convergence errors to be corrected at the place where they occur and therefore is more effective. However although the corrctions are applied on the screen side of the plane of deflection it is also important that they are not made too close to the screen because they will adversely affect the beam landing.

In implementing the present invention the magnetisable substantially annular element may comprise one or more turns of a wire or a band formed of a magnetisable material having an average value of coercive field strength of 5 to 40 kA/m and an average value of remnant induction of 500 to 1500 mT. The annular element may be mounted on and shaped to follow the contour of the conical surface of the display tube envelope, which contour changes from circular at the neck to rectangular at the faceplate, or mounted within the deflection means either as a ring located internally of the deflection means or as a ring encapsulated in an insulating former carrying the coils of the deflection means. An advantage of the latter arrangement is that the ring is electrically insulated better from the coils.

Although the substantially annular element(s) is (are) able to make post deflection correction for static and dynamic convergence errors, the quantity of the corrections to be made may be enhanced by separate correction means, such as a multipole magnetisable ring carried by the electron gun system, for correcting static convergence errors originating from the electron guns prior to deflection. In consequence the corrections made by the annular element(s) are to compensate for the dynamic convergence errors due to the deflection means not being ideal.

BRIEF DESCRIPTION OF THE DRAWINGS

The present invention will now be described, by way of example, with reference to the accompanying drawings, wherein.

In the drawings, corresponding reference numerals have been used to indicate similar features in each of the embodiments.

Figure 1:
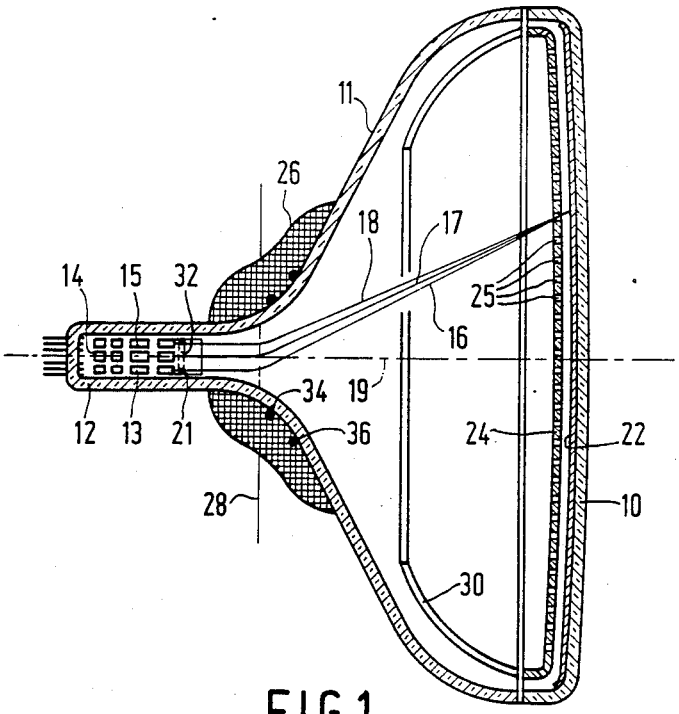
FIG. 1 is a diagrammatic cross section through a display tube system made in accordance with the present invention.

The display tube shown in FIG. 1 comprises an envelope formed by an optically transparent faceplate 10 and a conical portion 11 to which a neck 12 is connected. Within the neck 12 three in-line electron guns 13, 14 and 15 are provided for generating respective electron beams 16, 17 and 18. The axes of the electron guns 13, 14 and 15 are situated in one plane, the plane of the drawing. The axis of the central electron gun 14 coincides substantially with the longitudinal axis 19 of the envelope. The electron guns 13, 14 and 15 debouch into a sleeve 21, generally referred to as the centering sleeve, which is arranged in the neck 12 coaxially with the axis 19. A cathodoluminescent screen 22 comprising a large number of triplets of phosphor lines is provided on the inside of the faceplate. Each triplet comprises phosphor lines luminescing in green, blue and red, respectively. These phosphor lines are normal to the plane of the drawing. A shadow mask 24 is arranged adjacent to, but spaced from, the screen 22 and has a very large number of elongate apertures 25 through which the electron beams 16, 17 and 18 pass. A magnetic shield 30 extends rearwards from the shadow mask 24 and serves to screen the electron beams 16, 17 and 18 from the earth's magnetic field.

The electron beams 16, 17 and 18 are deflected in the horizontal direction (in the plane of the drawing) and in the vertical direction (at right angles to the plane of the drawing) by a system 26 of deflection coils. The three electron guns are assembled so that the axes thereof enclose a small angle with each other. As a result, the generated electron beams pass through the apertures 25 at this small angle, and each impinges only upon phosphor lines of one colour. The trajectories of the deflected electron beams bend at what is termed the plane 28 of deflection. As shown in FIG. 1 this plane is located in proximity of the neck-cone transition of the envelope.

In the course of the manufacture of the tube, static convergence errors originating from the electron guns and their mounting in the neck 12 are corrected for example by permanently magnetizing as a multipole a magnetisable ring 32 provided in the sleeve 21. A method by which this is done is disclosed in British Patent Specification No. 2.000.635B, details of which are incorporated herein by way of reference. However when the system 26 of deflection coils, termed the deflection yoke, is subsequently positioned on the neck 12, some residual static convergence errors as well as some dynamic convergence errors may be noted. By way of illustration the effect of such errors on the alignment of the beam spots is illustrated in the top right hand corner of FIG. 2 where R, G and B refer to the red, green and blue beams, respectively.

Such errors are reduced or substantially eliminated in a display tube made in accordance with the present invention by providing permanently magnetisable substantially annular elements 34 and 36, for example rings, bands or turns of wire, which are arranged externally of the envelope between the plane 28 and the magnetic shield 30 and which surround the electron beam paths. The annular elements 34, 36 may comprise an alloy of Fe, Co, V and Cr (known as Vicalloy) or another magnetic material having average values of coercive field strength of 5 to 40 kA/M and average values of remnant induction of 500 to 1500 mT. It is necessary for the or each annular element to be located on the screen side of the plane of deflection because they (or it) correct(s) landing errors due to convergence errors. However the correction of these convergence errors cannot be optimized until the paths of the electron beams are distinctive and errors become apparent. The effect of the corrections, once determined and corrected, is to make the deflection coil, which was assumed to be within the required performance specification, ideal.

Figure 3:
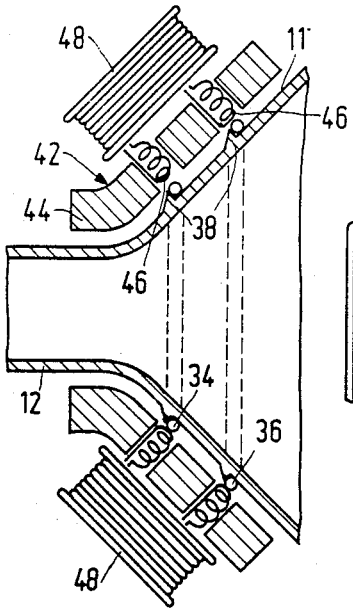
FIG. 3 is a cross section through a portion of a display tube and a magnetizing device.

In FIGS. 1 and 3, an embodiment is shown in which the annular elements 34, 36 are positioned on and follow the contour of the external surface of the conical portion 11 which contour is circular at the neck end and rectangular at the faceplate end. Detents 38 are provided to maintain the annular elements 34, 36 in position.

Figure 2:
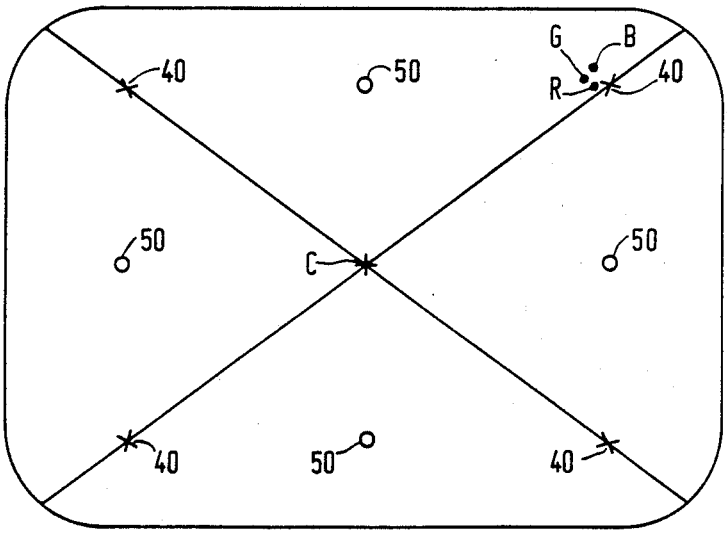
FIG. 2 is an elevational view of a faceplate indicating the points which are monitored for alignment checks.

In order to decide on the nature and strength of the multipoles to be induced into the elements 34, 36, a deflection yoke 26 is positioned on the neck in the usual way and the tube is energized. Convergence measurements are made at a number of predetermined points on the screen, for example as shown in FIG. 2 at the centre C of the screen and at points 40 located approximately three quarters of the way along each diagonal as measured from the centre. The results are used to compute the nature and strengths of the magnetic fields to be induced in the annular elements 34, 36 to produce the required corrections. More particularly all the measurements are taken together, the errors are computed by a process of addition and subtraction, and finally the total correction is determined.

Figure 4:
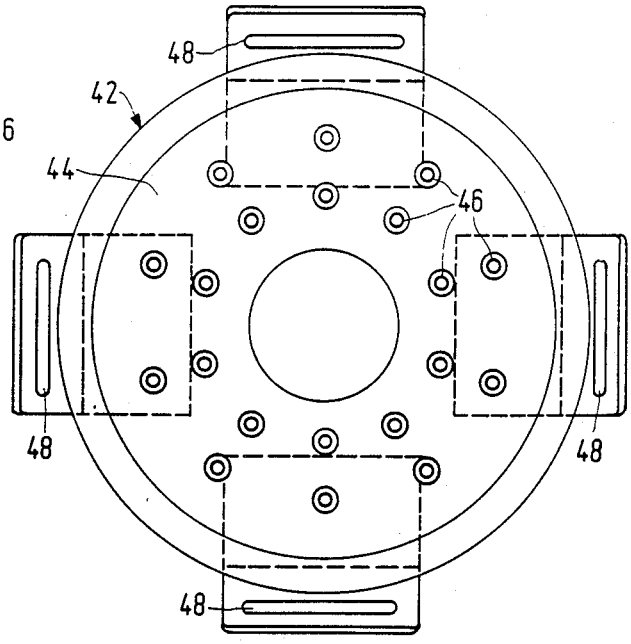
FIG. 4 is a diagrammatic front elevational view of the magnetizing device shown in FIG. 3.

The deflection yoke 26 is then removed and a magnetizing yoke 42 is fitted in its place as shown in FIG. 3. The yoke 42 comprises a housing 44 made of a non-magnetic material, the precise shape of the housing conforming to the shape of the conical portion 11 of the envelope on to which it is fitted. As shown in FIG. 4, a series of ten parts of radially extending magnetizing coils 46 are disposed equi-angularly at locations corresponding to the annular elements 34, 36. Each coil 46 is connected to its respective source of controllable magnetizing current (not shown). Four other coils 48 are mounted on the housing 44 outwardly of the magnetizing coils 46. The coils are spaced equi-angularly about the exterior of the housing 42. Each of the coils 46 have the required d.c. magnetizing current applied to produce magnetic poles in each element 34, 36 of a strength to obtain the required correction, while simultaneously a decaying alternating current is applied to the coils 48. At switch-on the alternating current is so large that the ring is fully magnetized on either side of the hysteresis curve. The alternating current is allowed to decay to zero leaving the d.c. magnetizing current applied to the coils 46. By this technique the poles can be magnetized rapidly in a single operation.

Thereafter the deflection yoke 26 is replaced and a further check is made and if the alignment is satisfactory no further changes are made. Alternatively if it is unsatisfactory the above mentioned process is repeated and the annular elements 34, 36 are remagnetized.

In order to obtain a greater precision, convergence measurements may be made at additional points, such as the points 50 shown in FIG. 2 disposed three quarters along each of the axes from the centre C.

Figure 5:
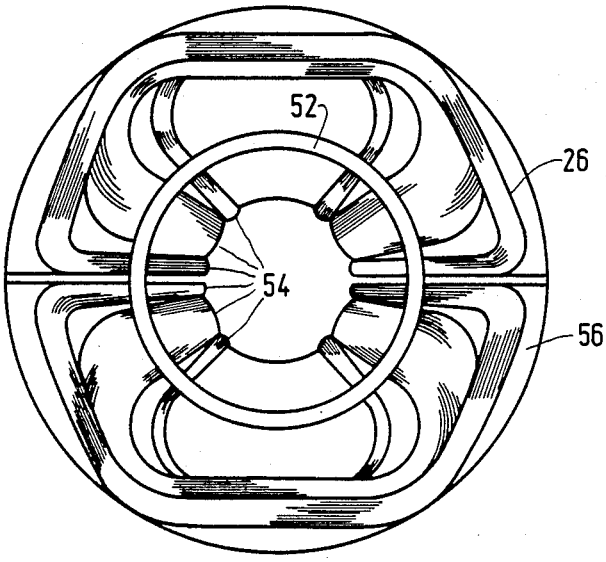
FIG. 5 is a front elevational view of a deflection yoke having a magnetisable ring positioned against the saddle coils.
Figure 6:
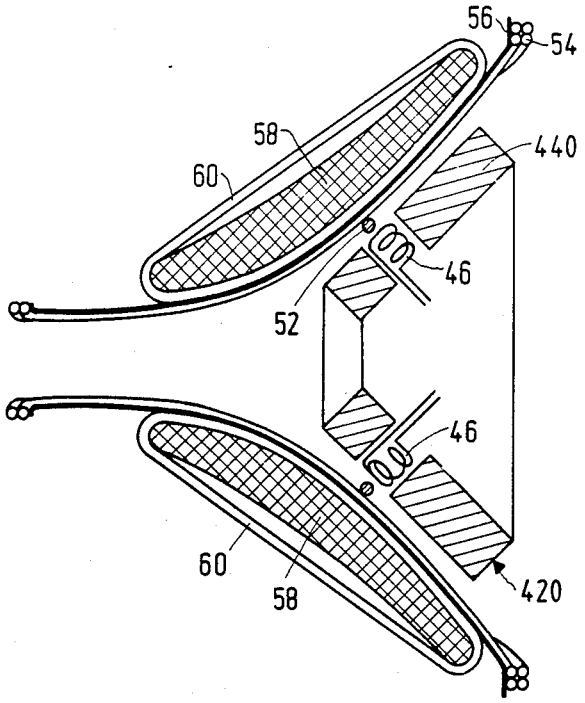
FIG. 6 is a diagrammatic cross-sectional view of one arrangement for positioning and magnetizing the ring shown in FIG. 5 as a multipole.

FIGS. 5 and 6 illustrate a second embodiment of the invention in which a single permanently magnetisable ring 52 is mounted inside the deflection yoke 26 so that the plane of the ring is disposed transversely of the saddle coils 54 arranged in a two-part plastics housing 56 and is located on the screen side of the plane of deflection. Around the outside of the housing 56 is arranged a two-part ring core 58 of magnetisable material. Each part of the core 58 has a toroidally wound coil 60 thereon.

The method of magnetizing the ring 52 is generally the same as that described already with respect to FIGS. 3 and 4 but with the following differences. The decaying alternating current filed is applied to the saddle coils 54 and the toroidally wound coils 60. In magnetizing yoke 420, the coils 46 for inducing the required multipole field are mounted in housing 440 which fits inside the deflection yoke 26 to such an extent that the coils 46 contact the ring 52 in order to obtain a close magnetic coupling.

Figure 7:
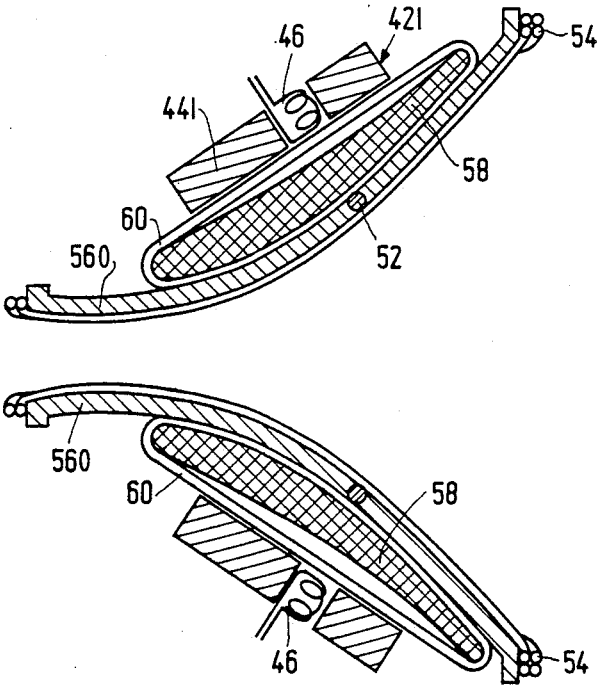
FIG. 7 is a diagrammatic cross-sectional view of another arrangement for positioning and magnetizing the magnetisable ring shown in FIG. 5, wherein the ring is encapsulated in an insulating former.

In order to avoid the risk of the ring 52 in FIGS. 5 and 6 from electrically shorting-out the turns of the saddle coils 54, FIG. 7 shows an embodiment in which the ring 52 is encapsulated in the housing 560 which is of single part construction. In this embodiment the device 421 for magnetizing the multipoles is disposed externally of the ring core 58 and the decaying alternating current field is applied via the coils 54 and 60.

Although the embodiment of FIGS. 1 to 4 illustrates the provision of two annular elements 34, 36, a larger number of annular elements may be provided on the conical portion 11 of the envelope and a suitably constructed magnetizing device 42 used to induce the required multipole fields. However the length of the magnetic shield 30 may have to be reduced. Furthermore the magnetized annular element(s) should not be located too close to the screen 22 otherwise they may have an adverse effect on the beam landing.

What is claimed is:

1. A method of correcting electron beam misconvergence in a color display tube comprising: an envelope consisting of an optically transparent faceplate, a conical portion and a neck, and within the envelope an electron gun system in the neck and a cathodoluminescent screen on the inside of the faceplate; electron beam deflection means being arranged on the neck-cone transition of the envelope; the method comprising: providing at least one magnetisable substantially annular element externally of the envelope at, or on the screen side of, the plane of deflection of the deflection means; measuring the convergence of the electron beams at the screen with the deflection means in place; and magnetising the annular element as a multipole, the number of poles and their respective strengths being such as to correct for the measured dynamic convergence errors.

2. A method as claimed in claim 1, wherein the deflection means are removed prior to the step of magnetising the annular element.

3. A method as claimed in claim 1, wherein at least one annular element is provided on the conical portion of the envelope.

4. A method as claimed in claim 1, wherein a single annular element is secured in the deflection means.

5. A method as claimed in claim 1, wherein the annular element is magnetised from inside the deflection means.

6. A method as claimed in claim 1, wherein the annular element is magnetised from outside the deflection means.

7. A method as claimed in claim 1, wherein the annular element is magnetised using a combination of a multipole d.c. field and a decaying alternating current field.

8. A colour display tube system comprising: a colour display tube having an envelope consisting of an optically transparent faceplate, a conical portion and a neck, and within the envelope an electron gun system in the neck for producing a plurality of electron beams and a cathodoluminescent screen on the inside of the faceplate; and an electron beam deflection means arranged on the neck-cone transition of the envelope, the deflection means having a plane of deflection; characterized in that at least one substantially annular element permanently magnetized as a mutlipole is provided externally of the envelope on the screen side of the plane of the deflection, the number of poles and their respective strengths being such as to correct for measured dynamic convergence errors.

9. A system as claimed in claim 8, wherein the annular element comprises one or more turns of wire.

10. A system as claimed in claim 8, wherein the annular element comprises a band.

11. A system as claimed in claim 8, wherein the annular element is mounted on the external surface of the envelope.

12. A system as claimed in claim 11, wherein at least two elements are mounted on the external surface of the envelope with a space therebetween.

13. A system as claimed in claim 8 wherein a single annular element is mounted within the deflection means.

14. A system as claimed in claim 13, wherein the annular element is encapsulated in a former carrying coils of the deflection means.

15. A system as claimed in claim 8 wherein the or each annular element comprises a magnetic material having an average value of coercive field strength of the 5 to 40 kA/m and an average value of remenent induction of 500 to 1500 mT.

16. A system as claimed in claim 8 wherein an annular element permanently magnetised as a multipole carried by the electron gun system.

* * * * *